US008360671B2

(12) United States Patent
Jun

(10) Patent No.: US 8,360,671 B2
(45) Date of Patent: Jan. 29, 2013

(54) LEAK-PROOF ART INSTRUMENT

(75) Inventor: Qiu Jun, Foshan (CN)

(73) Assignee: Horizon Group USA, Inc., Warren, NJ (US)

( * ) Notice: Subject to any disclaimer, the term of this patent is extended or adjusted under 35 U.S.C. 154(b) by 335 days.

(21) Appl. No.: 12/845,275

(22) Filed: Jul. 28, 2010

(65) Prior Publication Data

US 2012/0027500 A1 Feb. 2, 2012

(51) Int. Cl.
*B43K 5/00* (2006.01)

(52) U.S. Cl. ..... 401/205; 401/186

(58) Field of Classification Search ..... 401/205, 401/206, 183, 186, 270
See application file for complete search history.

(56) References Cited

U.S. PATENT DOCUMENTS

| | | | | |
|---|---|---|---|---|
| 4,748,990 | A * | 6/1988 | Brown et al. | 132/320 |
| 5,035,525 | A * | 7/1991 | Konose | 401/278 |
| 6,536,969 | B2 | 3/2003 | Nishitani | |
| 6,746,170 | B2 * | 6/2004 | Delage | 401/266 |
| 7,172,360 | B2 | 2/2007 | McSweeney et al. | |
| 7,976,236 | B2 * | 7/2011 | Oomoto | 401/206 |
| 2006/0228163 | A1 | 10/2006 | McSweeney et al. | |

FOREIGN PATENT DOCUMENTS

WO WO 2009/141747 A1 11/2009

OTHER PUBLICATIONS

International Search Report mailed Mar. 22, 2012 issue in related International Application PCT/2011/043983 (2 pages).
Written Opinion of the International Searching Authority mailed Mar. 22, 2012 issue in related International Application PCT/2011/043983 (4 pages).

* cited by examiner

*Primary Examiner* — David Walczak
*Assistant Examiner* — Jennifer C Chiang
(74) *Attorney, Agent, or Firm* — Robert P. Michal; Lucas & Mercanti, LLP

(57) ABSTRACT

Art instrument having a self-contained reservoir for storing and dispensing application liquid includes a reservoir body for containing the application liquid and a dispensing assembly that dispenses the application liquid from the reservoir. The dispensing assembly includes an applicator, a primary orifice restrictor including a channel, a movable actuating assembly that retains the applicator and the primary orifice restrictor and is movably connected to the reservoir body, and a secondary orifice restrictor arranged in an opening of the reservoir body and includes an initially closed channel. The instrument also includes a partly movable control mechanism that controls movement of the actuating assembly relative to the reservoir body. The control mechanism having a configuration in which it prevents opening of the closed channel and thereby prevents leakage of application liquid from the reservoir prior to manual activation by a user.

24 Claims, 3 Drawing Sheets

LEAK-PROOF ART INSTRUMENT

FIELD OF THE INVENTION

The present invention is directed to art instruments, and more particularly to art instruments having a self-contained reservoir for dispensing paint or ink to an applicator provided at one end of the instrument.

The present invention also relates to a method for activating an art instrument having a self-contained reservoir for storing and dispensing application liquid without requiring removal of any component from the art instrument, thereby simplifying the activation process.

BACKGROUND OF THE INVENTION

One type of art instrument includes an internal reservoir portion for holding water, colored inks, paints, and other liquid art media (hereinafter collectively referred to as "application liquid") and a brush portion connected to the reservoir portion wherein the application liquid passes to the brush portion in a controlled manner to be deposited onto a Examples of such instruments include those disclosed in U.S. Pat. No. 6,536,969 (Nishitani) and U.S. Pat. No. 7,172,360 (McSweeney et al.) and the Art-Kure Watercolour System Colour Sketch Brush discussed in McSweeney et al. All of these references are incorporated by reference herein.

It has been found that a problem with such instruments, the application liquid is prone to leak out of the instrument when shipped via air, e.g., when exposed to low pressure at high altitudes.

Therefore, it would be beneficial to have an improved art instrument that provides a controllable flow of application liquid and is substantially leak-proof when exposed to low pressure and thereby allows the instrument to be shipped via air without concern of leakage.

Moreover, these art instruments generally require removal of a component in order to activate the instrument, activation being the initial, manual procedure to allow for dispensing of application liquid by the instrument. For example, the instrument disclosed in McSweeney et al. has a ring between threaded parts with the ring preventing complete engagement of the threaded parts and thus dispensing of application liquid. The ring must be removed by the user to activate the instrument and this requires separation of the threaded parts from one another, removal of the ring therebetween and then re-threading of the parts together without the ring. This is a cumbersome procedure and necessitates additional effort to use the art instrument.

SUMMARY OF THE INVENTION

An art instrument in accordance with the invention has a reservoir body for containing application liquid and a dispensing assembly that dispenses the application liquid from a reservoir in the reservoir body. The dispensing assembly includes an applicator, a primary orifice restrictor including a channel, a movable actuating assembly that retains the applicator and the primary orifice restrictor and that is movably connected to an open end of the reservoir body, and a secondary orifice restrictor arranged in an opening of the reservoir body and that includes an initially closed channel. The instrument also includes a partly movable control mechanism that controls movement of the actuating assembly relative to the reservoir body.

The control mechanism has a first configuration on the reservoir body in which it allows the channel of the primary orifice restrictor to be in flow communication with the channel of the second orifice restrictor (which flow communication is obtained by moving the actuating assembly relative to the reservoir body) and a second configuration on the reservoir body in which it prevents engagement of the primary orifice restrictor with the second orifice restrictor. In this second configuration, the control mechanism would prevent opening of the channel of the secondary orifice restrictor (if not already opened) to thereby maintain the channel in a closed state until manual movement of the control mechanism into the first configuration.

The initial manual movement of the control mechanism, when the channel of the secondary orifice restrictor is still closed, is referred to as activation and thus prior to activation, the channel is closed as a result of its formation thereby allowing the instrument to be shipped while exposed to low pressure without fear of leakage of the application liquid from the reservoir.

Specifically, the control mechanism includes a movable regulating ring arranged around the open end of the reservoir body and that is maintained on the reservoir body during movement of the control mechanism between the first and second configurations, i.e., removal of the regulating ring is not required for activation. This provides yet another advantage, in comparison to conventional art instruments mentioned above, in that it is possible to activate the instrument without requiring separation of components of the instrument.

The regulating ring has an annular portion having an inner diameter that is larger than an outer diameter of the reservoir body at the open end and control flanges extending from the annular portion toward a closed end of the reservoir body. The control mechanism also includes positioning slots arranged on an outer surface of the reservoir body that selectively receive the control flanges. Each positioning slot is either a pre-activation slot or a post-activation slot. When the control flanges engage the pre-activation slots, the control mechanism is in the second configuration preventing engagement of the primary orifice restrictor with the secondary orifice restrictor and thus opening of the channel of the second orifice restrictor, if not already opened.

The art instrument constructed in this manner is therefore activatable without requiring removal of any component from the art instrument, in particular the ring that is interposed between the threaded parts. Rather, the ring is initially positioned to limit movement of the actuating assembly and prevent engagement of the primary orifice restrictor with the second orifice restrictor and thus opening of the channel of the secondary orifice restrictor to thereby maintain the channel in a closed state. Then, when activation of the art instrument is desired, the ring is manually adjusted, without removing it from its position interposed between the reservoir body and the dispensing assembly, to enable the ring to be brought to a position in which it allows movement of the actuating assembly to a position in which the channel of the primary orifice restrictor is in flow communication with the channel of the second orifice restrictor and thus enables dispensing of application liquid from the reservoir.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

The invention may best be understood by reference to the following detailed description of and illustrative embodiment when read in conjunction with the accompanying drawings, wherein.

DETAILED DESCRIPTION OF THE INVENTION

Figure 1:
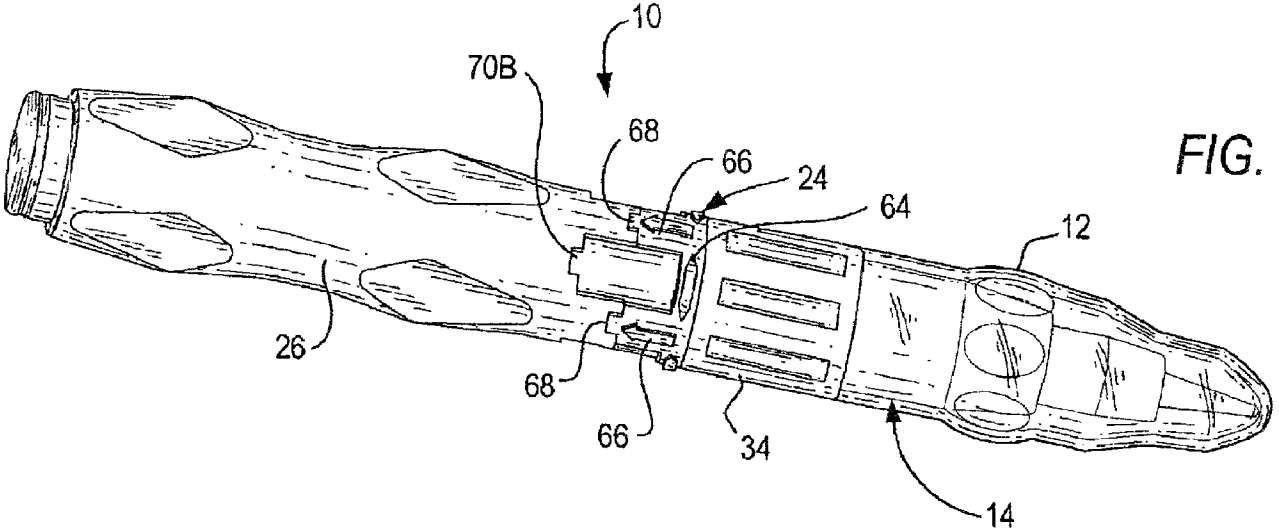
FIG. 1 is a perspective view of an art instrument in accordance with the invention in a shipping and storage state.

Referring to the accompanying drawings wherein the same reference numbers refer to the same or similar elements, FIG. 1 illustrates a perspective view of an art instrument in accordance with the invention, designated 10, having a self-contained reservoir of application liquid, means for controlling dispensing of the application liquid from the reservoir to an applicator for distributing the application liquid onto a surface, and means for requiring activation of the instrument in order to use it, whereby prior to activation, the application liquid cannot leak out of the reservoir. Thus, the instrument comprises a plurality of interconnected parts that operate to permit a user to controllably release application liquid from the reservoir through the applicator for dispensing onto the surface, yet provide the instrument with a shipping, pre-use state in which the application liquid cannot leak from the reservoir, even when the instrument is exposed to low ambient air pressure, e.g., when shipped via air.

More specifically, the instrument 10 includes a cap 12, a nozzle 14, a valve body 16, an applicator 18, a primary orifice restrictor a secondary orifice restrictor 22, a regulating ring 24, and a reservoir body 26. Optionally, the instrument 10 includes a sealing mechanism for sealing a reservoir 28 in the reservoir body 26, e.g., an O-ring 30 arranged between an outer surface of the secondary orifice restrictor 22 and an inner surface of the reservoir body 26. Each component may be dimensioned to securely fit against and/or nest into any mating components. The tight fit and interconnection of the components provides a leak-proof assembly that, as described more fully below, can easily be activated by a user to controllably dispense application liquid contained in the reservoir 28 of the instrument 10 onto the surface being painted.

Cap 12 serves to cover the exposed applicator 18 when the instrument 10 is not in use. The cap 12 includes an open end portion and an opposite closed end portion. The open end portion is dimensioned and shaped so as to form a watertight seal when placed over and pressed against a brush end of the nozzle 14 (as shown in FIGS. 1-5). An inner surface of the open end portion of the cap 12 and an outer surface of the nozzle 14 may include cooperating fitting means, e.g., one or more grooves and one or more corresponding raised ridges that produce a snap-fit closure. Optionally, the cap 12 may be vented, such as by providing pores or slots in a sidewall to permit pressure to escape after activation of the instrument 10, such as in storage after activation.

Figure 2:
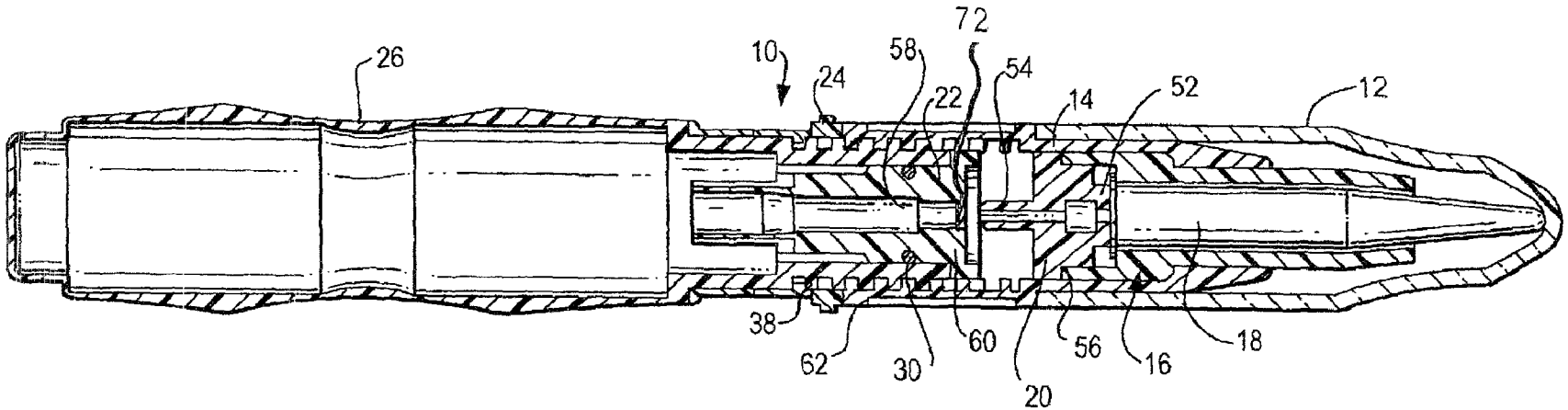
FIG. 2 is a cross-sectional view of the instrument in accordance with the invention in the shipping and storage state.
Figure 4:
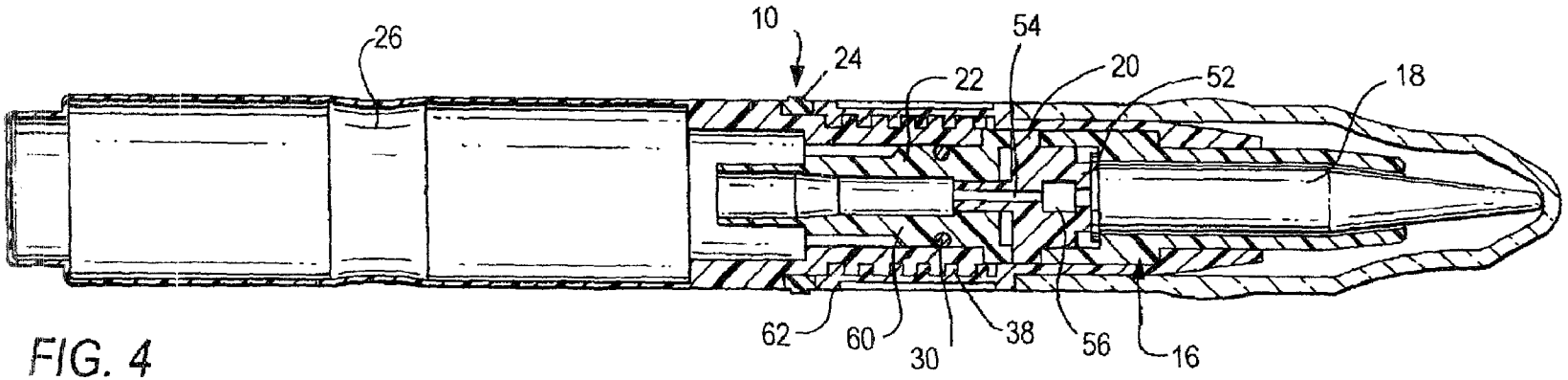
FIG. 4 is a cross-sectional view of the instrument in accordance with the invention in the use state.
Figure 5:
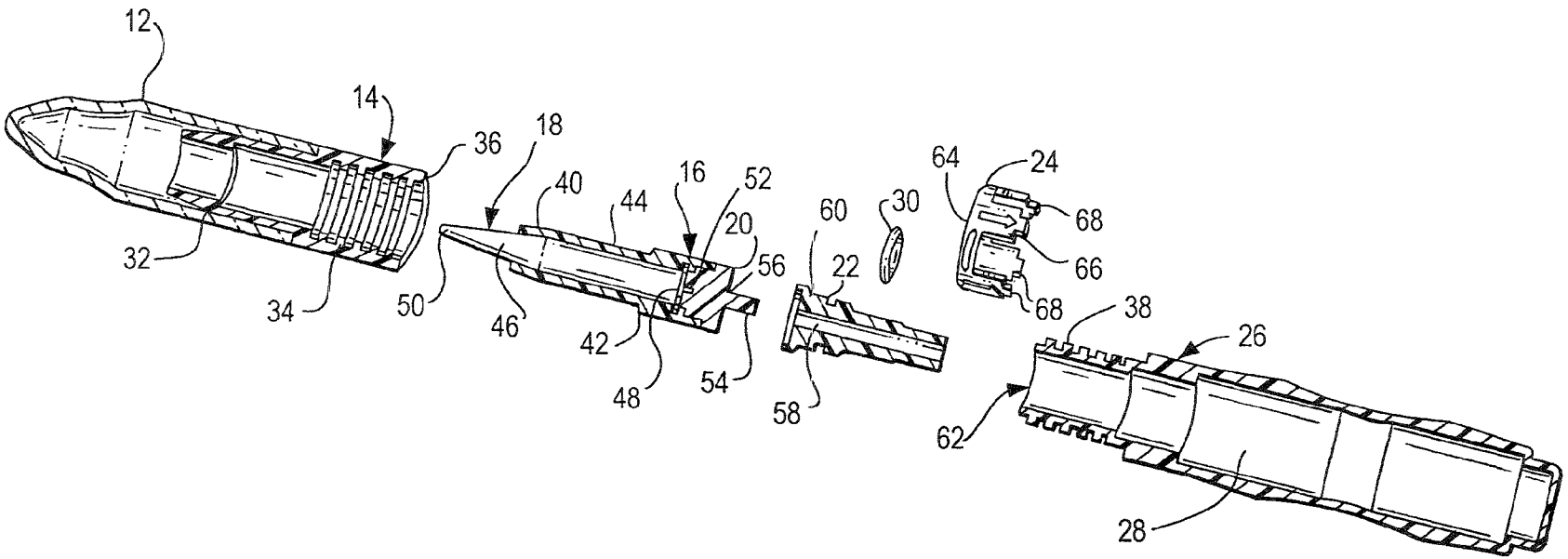
FIG. 5 is a partially exploded view of the instrument in accordance with the invention.

Nozzle 14 is a hollow, generally cylindrical piece that includes a body portion having the brush end region 32 dimensioned and shaped so as to receive the open end of the cap 12, and a threaded end region 34 opposite the brush end and that has an inner surface with threads 36 (see FIG. 5). The body portion may include a textured outer surface, rubber coating, or other known grip-enhancing features to assist in providing a user with adequate grip to control the instrument even when the user's hands are wet, e.g., the axially extending grooves and ridges as shown in FIGS. 1 and 2. The threaded end region 34 permits a secure and watertight connection of the nozzle 14 to the reservoir body 26 via the threads 36 on the inner surface of the nozzle 14 and corresponding threads 38 at an open, threaded end of the reservoir body 26 (see FIG. 5).

Valve body 16 serves to receive and securely retain the applicator 18 of the instrument 10 and the primary orifice restrictor 20, and to enable a regulated flow of application liquid from the reservoir 28 to the applicator 18. Another purpose of the valve body 16 is to provide a housing to position the applicator 18 against the primary orifice restrictor 20. If the applicator 18 is not positioned properly against the primary orifice restrictor 20, then the application liquid flow will not be directed smoothly to the distal end of the applicator 18.

The valve body 16 is generally cylindrical, having a slightly tapering distal end portion 40 with a distal opening, a substantially cylindrical base portion 42 having a base opening, and a substantially cylindrical sidewall portion 44 located between the distal end portion 40 and the base portion 42. The valve body 16 further includes a longitudinal passageway having a predetermined diameter that connects the base opening at the base portion 42 and the distal opening at the distal end portion 40. The outer surface of the valve body 16 may be constructed to permit the valve body 16 to securely and frictionally fit inside the nozzle 14, and to securely meet the primary orifice restrictor 20 for a watertight connection adjacent a capped end of the applicator 18. The valve body 16 further includes an inner diameter that is compatible with the applicator 18 to permit the applicator 18 to be inserted into and securely retained by inner surface of the valve body 16. The inner surface of the valve body 16 may include a retaining structure on the internal surface to securely hold the capped end of the applicator 18. Variations of the valve body 16 may be used, e.g. , those disclosed in McSweeney et al. referenced above.

The applicator 18 may be formed in different ways and from different materials depending on the use of the instrument 10. In the illustrated embodiment, the applicator 18 is formed as a brush and includes a generally conical assembly of bristles 46 secured into a common assembly by a cap member 48 at the capped end and having a tapered end 50 opposite the cap member 48. The cap member 48 can be porous or non-porous, and may permit application liquid to flow through and/or around the cap member to reach the bristles 46. Upon initial activation of the instrument 10, the proximity of the capped end of the applicator to the primary orifice restrictor 20 permits application liquid to flow from the restrictor 20 onto the bristles 46 in the applicator 18.

The primary orifice restrictor 20 is a substantially disk-shaped valve having a substantially circular first end 52 that is positioned adjacent or in engagement with the cap member 48 of the applicator 18 (see FIGS. 3-5), and an opposite protruding tube end 54 that is selectively connectable to the secondary orifice restrictor 22. The primary orifice restrictor 20 includes an axially extending channel 56 that connects the first end 52 and the opposite tube end 54. The protruding tube end 54 is preferably configured so as to frictionally fit inside of an axial channel 58 in the secondary orifice restrictor 22. The primary orifice restrictor 20 may be similar to the primary orifice restrictor 6 disclosed in McSweeney et al. and have the same properties thereas.

The secondary orifice restrictor 22 is a substantially cylindrical-shaped valve having a substantially circular first end region 60 dimensioned to mate with a threaded end region 62 of the reservoir body 26, at which the threads 38 are situated, to form a watertight seal. Optionally, the first end region 60 of the secondary orifice restrictor 22 is arranged to engage the annular flexible sealing ring 30, such as a rubber O-ring, to form a tight seal between the threaded end region 62 of the reservoir body 26 and the secondary orifice restrictor 22. Sealing ring 30 therefore preferably approximates an inner, sidewall diameter of the threaded end region 62 of the reservoir body 26.

The first end region 60 includes part of the axial channel that receives the protruding tube end 54 of the primary orifice restrictor 20. The inner diameter of the channel 58 at the first end region 60 is greater than the outer diameter of the protruding tube end 54 so as to enable insertion of the tube end 54 into the channel 58 at the first end region 60 and to retain the tube end 54 by friction alone. Channel 58 has a variable diameter, from a larger diameter at an end opening into the reservoir 30 in reservoir body 28 to a small diameter at the first end 60 (see FIGS. 3-5). The secondary orifice restrictor 22 may have other features like the secondary orifice restrictor disclosed in McSweeney et al. and have the same properties thereas.

The reservoir body 26 includes a generally cylindrical body portion having the threaded end 62 and an opposite closed end. The reservoir body 26 is of sufficient size and diameter so as to act as the storage reservoir 28 for an amount of application liquid, e.g., ink, to permit painting without requiring frequent refills. For example, the reservoir 28 can holds between about 0.1 to about 2 ounces of liquid. Preferably, the reservoir body 10 is also refillable by unthreading and removing the nozzle 14 and other components to permit a user access to the open end of the reservoir body 26. The reservoir body 26 should preferably be made from a flexible material such as high-density polyethylene (HDPE), and should have wall thickness of between about 0.01 inches to 0.09 inches to allow for easy squeezing by a user to activate the liquid dispensing system of the instrument 10.

An important aspect of the instrument 10 is the presence of a control mechanism that maintains the reservoir 28 in the reservoir body 26 in a closed state prior to activation of the instrument 10 by the user. That is, during manufacture of the instrument 10, application liquid is placed into the reservoir and sealed therein and until activated by the user, the instrument 10 will not leak application liquid from the reservoir 28.

This leakage prevention is provided by the formation of the secondary orifice restrictor 22 with its channel 58 initially closed at the first end region 60. Since the channel 58 is closed at the front end region 60, and not opened until manual activation of the instrument 10 by the user, application liquid cannot leak from the reservoir 28 through the secondary orifice restrictor 22. This therefore allows the instrument 10 to be shipped via air without concern that the exposure to low air pressure will cause leakage of the application liquid from the reservoir 28 as may occur in prior art instruments 10, discussed above.

An exemplifying construction of the control mechanism is shown in FIGS. 1-5 and comprises the regulating ring 24. Regulating ring 24 has an annular portion 64 whose inner diameter is larger than the outer diameter of the threads 38 at the threaded end region 62 of the reservoir body 26 to enable the regulating ring 24 to be easily slid over the threads 38 onto the reservoir body 26. Regulating ring 24 also includes a number of control flanges 66 extending axially in a common direction from the annular portion 64. In the illustrated embodiment, the regulating ring 24 includes four control flanges 66 approximately equally spaced around the annular portion 64, although the number of control flanges 66 may vary, and even a single control flange may be provided. Each control flange 66 includes a projection 68 at a distal end that has a width that is smaller than the width of the distal end.

The control mechanism further comprises a specific formation of slots on an outer surface of the reservoir body 26 that selectively receive with the control flanges 66 and their projections 68. Specifically, the outer surface of the reservoir body 26 includes a series of positioning slots 70A, 70B, each adapted to individually receive one of the control flanges 66. Positioning slots 70A are pre-activation slots and positioning slots 70B are post-activation slots 70B, and the pre-activation slots 70A alternative with the post-activation slots 70B around the periphery of the reservoir body 26 so that the regulating ring 24 is positionable in a first position in which the projections 68 of the control flanges 66 are received in only pre-activation slots 70A and in a second position in which the control flanges 66 and their projections 68 are received in only post-activation slots 70B. Pre-activation slots 70A have a smaller depth along the outer surface of the reservoir body 26 than the post-activation slots 70B.

The regulating ring 24 therefore controls the ability of the primary orifice restrictor 20 to engage the secondary orifice restrictor 22 and thus either permit or prevent flow of application liquid from the reservoir 28 in reservoir body 26 to the applicator 18. Moreover, the regulating ring 24 controls the ability of the primary orifice restrictor 20 to be manually moved to a position in which the tube end 54 pierces the initially, closed channel 58 and this therefore enables the secondary orifice restrictor 22 to have a closed state prior to manual activation.

Accordingly, when the regulating ring 24 is positioned such that the control flanges 66 and their projections 68 are received in the pre-activation slots 70A, i.e., prior to packaging and shipping of the instrument 10, the primary orifice restrictor 22 cannot be moved to cause the protruding tube end 54 to fit inside of the axial channel 58 in the secondary orifice restrictor 22. Movement of the primary orifice restrictor 20 relative to the secondary orifice restrictor 22 is enabled by rotation of the nozzle 14 and valve body 16 received therein relative to the reservoir body 26 but such rotation is limited once the control flanges 66 and projections 68 are received in the pre-activation slots 70A.

Figure 3:
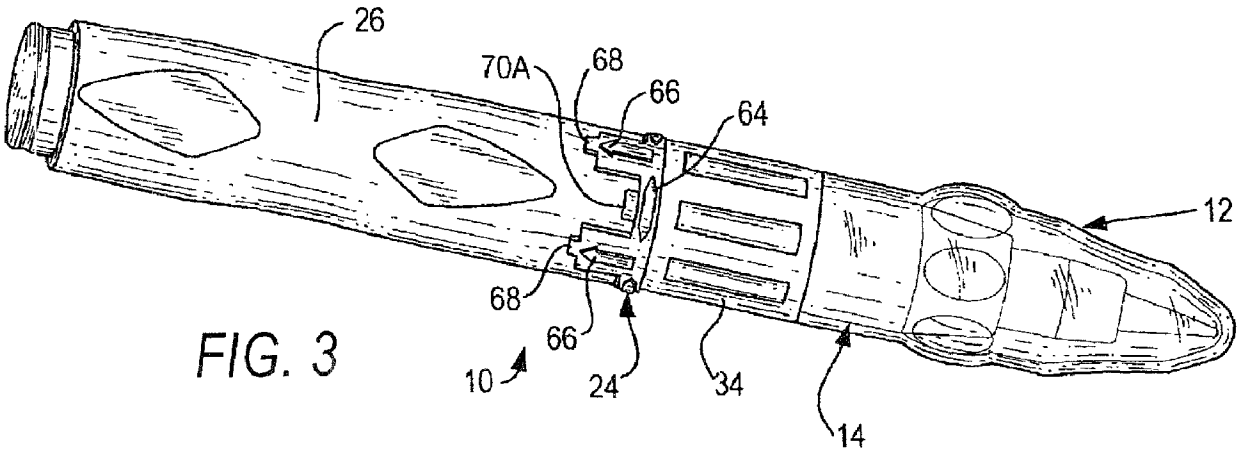
FIG. 3 is a perspective view of the instrument in accordance with the invention in a use state in which it can be used when a cap is removed.

To this end, the pre-activation slots 70A are formed on the outer surface of the reservoir body 26 to allow movement of the primary orifice restrictor 20 upon rotation of the valve body 16 relative to the reservoir body 26 only up to a point where the tube end 54 of the primary orifice restrictor 20 is not in engagement with the channel 58 in the secondary orifice restrictor 22 (to the position shown in FIG. 3 when the control flanges 66 and projections 68 are received in the pre-activation slots 70A as shown in FIG. 1). On the other hand, the post-activation slots 70B are formed on the outer surface of the reservoir body 26 to allow movement of the primary orifice restrictor 20 upon rotation of the valve body 16 relative to the reservoir body 26 to the point where the tube end 54 of the primary orifice restrictor 20 is engaged with the channel 58 in the secondary orifice restrictor 22 (to the position shown in FIG. 4 when the control flanges 66 and projections 68 are received in the post-activation slots 70B as shown in FIG. 2).

Thus, leakage of application liquid from the reservoir 28 in the reservoir body 26 is prevented because the channel 58 in the secondary orifice restrictor 22 is maintained in a closed state prior to manual activation of the instrument 10.

Manual activation of the instrument 10 entails rotating the nozzle 14 relative to the reservoir body 26 to enable the regulating ring 24 to be axially moved until the control flanges and projections 68 can be removed from the pre-activation slots 70A, rotating the regulating ring 24 until the control flanges 66 align with the post-activation slots 70B and then rotating the nozzle 14 relative to the reservoir body 26 to cause the control flanges 66 and projections 68 to be engaged with the post-activation slots 70B. This causes the closure 72 of the channel 58 (as shown in FIG. 2) to be pierced or otherwise removed and thus provides for a fluid communication between the channel 58 in the secondary orifice restrictor 22 and the primary orifice restrictor 20. As such, when the primary orifice restrictor 20 and the secondary orifice restrictor 22 are in engagement with one another, flow of application liquid from the reservoir 28 in reservoir body 26 to the applicator 18 is possible, upon squeezing the reservoir body 26. When the primary orifice restrictor 20 is not be engaged with the secondary orifice restrictor 22, flow of application liquid from the reservoir 28 in reservoir body 26 to the applicator 18 is mostly prevented.

An exemplifying assembly of the instrument 10 by the manufacturer includes placing application liquid into the reservoir 28 in the reservoir body 26, placing the regulating ring 24 over the threaded end 62 of the reservoir body 26 such that the control flanges 66 are oriented toward the closed end of the reservoir body 26, and inserting the secondary orifice restrictor 22 into the reservoir body 26, with the optional O-ring 30 therebetween. Separately, the applicator 18 is inserted into the valve body 16, and the primary orifice restrictor 20 is placed into the valve body 16 adjacent the cap member 48 of the applicator 18. The cap 12 may be placed over the nozzle 14, and the threaded end of the nozzle 14 is slid over the valve body 16 and applicator 18 assembly until the nozzle 14 and cap 12 enclose the entire valve body and applicator assembly. The nozzle 14 is then threaded onto the reservoir body 26 to form the instrument 10. This threading is limited by aligning the control flanges 66 with the pre-activation slots 70A to thereby prevent engagement of the primary orifice restrictor 20 with the secondary orifice restrictor 22, i.e., penetration of the tube end 54 into the channel 58, and maintain the initial closure of the channel 58 of the secondary orifice restrictor 22.

Upon purchase of the instrument 10, the instrument 10 must be activated by a user to enable application of the application liquid to a substrate. An advantage of the invention is that this activation does not require any disassembly of the instrument by the user, as is required in prior art instruments. That is, the user does not have to, for example, separate the actuating assembly (which includes the nozzle 14 and valve body 16) from the reservoir body 26. Rather, the user only has to slightly loosen the actuating assembly from the reservoir body (by rotating them relative to one another in one direction) to enable the regulating ring 24 to be rotated or shifted from a position in which the control flanges 66 are engaged with the pre-activation slots 70A to a position in which the control flanges 66 align with the post-activation slots 70B.

Once the regulating ring 24 is in this position aligning with the post-activation slots 70B, the user rotates the actuating assembly in the opposite direction relative to the reservoir body 26 causing the primary orifice restrictor 20 to move closer to the secondary orifice restrictor 22 and continues this rotation until the protruding tube end 54 of the primary orifice restrictor 20 pierces the closure 72 of the axial channel 58 to be inside of the axial channel 58 in the secondary orifice restrictor 22. This movement is permitted because the control flanges 58 slide into the post-activation slots 70B. At this time, the instrument 10 is ready for use by squeezing the reservoir body 26. This causes application liquid from the reservoir 28 in reservoir body 26 to flow through the channel 58 in the secondary orifice restrictor 22, through the primary orifice restrictor 20, and into and/or around the cap member 48 to reach the bristles 46 in the applicator 18. Once flow of application liquid has thus commenced, a user can control the flow simply by exerting pressure such as by squeezing the reservoir body 26 to obtain faster liquid flow.

Having described exemplary embodiments of the invention with reference to the accompanying drawings, it will be appreciated that the present invention is not limited to those embodiments, and that various changes and modifications can be effected therein by one of ordinary skill in the art without departing from the scope or spirit of the invention as defined by the appended claims.

The invention claimed is:

1. An art instrument having a self-contained reservoir for storing and dispensing application liquid, comprising:

a reservoir body for containing the application liquid, said reservoir body having an open end including an opening;

a dispensing assembly that dispenses the application liquid from said reservoir, said dispensing assembly comprising:

an applicator;

a primary orifice restrictor including a channel;

a movable actuating assembly that retains said applicator and said primary orifice restrictor, said actuating assembly being movably connected to said open end of said reservoir body; and a secondary orifice restrictor arranged in said opening of said reservoir body and including an interior channel and a closure that closes said channel; and a partly movable control mechanism that controls movement of said actuating assembly relative to said reservoir body, said control mechanism having a first configuration on said reservoir body in which said control mechanism allows said channel of said primary orifice restrictor to be in flow communication with said channel of said second orifice restrictor and a second configuration on said reservoir body in which said control mechanism prevents engagement of said primary orifice restrictor with said second orifice restrictor and thus opening of said closure of said channel of said secondary orifice restrictor to thereby maintain said channel of said secondary orifice restrictor in a closed state until manual movement of said control mechanism into said first configuration.

2. The instrument of claim 1, wherein said primary orifice restrictor includes a protruding tube end through which said channel of said primary orifice restrictor passes and which is configured to frictionally fit inside of said channel of said secondary orifice restrictor, said primary orifice restrictor being arranged such that said protruding tube end opens said closure of said channel of said secondary orifice restrictor when said control mechanism is moved from said second configuration to said first configuration.

3. The instrument of claim 1, wherein said control mechanism comprises a movable regulating ring arranged around said open end of said reservoir body, said regulating ring being maintained on said reservoir body during movement of said control mechanism between said first and second configurations.

4. The instrument of claim 3, wherein said regulating ring comprises an annular portion having an inner diameter that is larger than an outer diameter of said reservoir body at said open end and at least one control flange extending from said annular portion toward a closed end of said reservoir body.

5. The instrument of claim 4, wherein said control mechanism further comprises positioning slots arranged on an outer surface of said reservoir body that selectively receive said at least one control flange, said slots including at least one pre-activation slot and at least one post-activation slot, said regulating ring being arranged such that when said at least one control flange is engaged in a respective one of said at least one pre-activation slot, said control mechanism is in said second configuration and when said at least one control flange is engaged in a respective one of said at least one post-activation slot, said control mechanism is in said first configuration.

6. The instrument of claim 5, wherein each of said at least one pre-activation slot has a smaller depth along said outer surface of said reservoir body than said at least one post-activation slot.

7. The instrument of claim 4, wherein said at least one control flange comprises a plurality of control flanges and a respective number of pre-activation slots and a respective number of post-activation slots, said pre-activation and post-activation slots alternating with one another around a periphery of said reservoir body.

8. The instrument of claim 4, wherein each of said at least one control flange comprises a projection at a distal end that has a width smaller than a width of the distal end.

9. The instrument of claim 1, wherein said actuating assembly comprises a valve body that retains said applicator and said primary orifice restrictor and a nozzle having an interior in which said valve body is situated such that movement of said valve body results in movement of said primary orifice restrictor, said nozzle being movably connected to said open end of said reservoir body.

10. An art instrument having a self-contained reservoir for storing and dispensing application liquid, comprising:

a reservoir body for containing the application liquid, said reservoir body having an open end including an opening;

dispensing means for dispensing the application liquid from said reservoir, said dispensing means comprising:

an applicator;

a primary orifice restrictor including a channel;

a movable actuating assembly that retains said applicator and said primary orifice restrictor, said actuating assembly being movably connected to said open end of said reservoir body; and a secondary orifice restrictor arranged in said opening of said reservoir body and including an interior channel and a closure that closes said channel; and control means for controlling movement of said actuating assembly relative to said reservoir body, said control means being arranged on or around said reservoir body and being arranged to require manual movement of a part thereof while said part is maintained on or around said reservoir body in order to open said closure of said channel of said secondary orifice restrictor by permitting movement of said actuating assembly relative to said reservoir body until said primary orifice restrictor engages said secondary orifice restrictor and opens said channel.

11. The instrument of claim 10, wherein said primary orifice restrictor includes a protruding tube end through which said channel of said primary orifice restrictor passes and which is configured to frictionally fit inside of said channel of said secondary orifice restrictor, said primary orifice restrictor being arranged such that said protruding tube end opens said closure of said channel of said secondary orifice restrictor when said regulating ring is moved from said second configuration to said first configuration.

12. The instrument of claim 10, wherein said manually movable part of said control means comprises a regulating ring arranged around said open end of said reservoir body.

13. The instrument of claim 12, wherein said regulating ring comprises an annular portion having an inner diameter that is larger than an outer diameter of said reservoir body at said open end and at least one control flange extending from said annular portion toward a closed end of said reservoir body.

14. The instrument of claim 13, wherein said control means further comprise positioning slots arranged on an outer surface of said reservoir body that selectively receive said at least one control flange, said slots including at least one pre-activation slot and at least one post-activation slot, said regulating ring being arranged such that when said at least one control flange is engaged in a respective one of said at least one pre-activation slot and said channel of said secondary orifice restrictor is closed, said control means prevent said primary orifice restrictor from opening said closure of said channel and when said at least one control flange is engaged in a respective one of said at least one post-activation slot, said control means allow said primary and secondary orifice restrictors to be in flow communication.

15. The instrument of claim 14, wherein each of said at least one pre-activation slot has a smaller depth along said outer surface of said reservoir body than said at least one post-activation slot.

16. The instrument of claim 13, wherein said at least one control flange comprises a plurality of control flanges and a respective number of pre-activation slots and a respective number of post-activation slots, said pre-activation and post-activation slots alternating with one another around a periphery of said reservoir body.

17. The instrument of claim 13, wherein each of said at least one control flange comprises a projection at a distal end that has a width smaller than a width of the distal end.

18. The instrument of claim 10, wherein said actuating assembly comprises a valve body that retains said applicator and said primary orifice restrictor and a nozzle having an interior in which said valve body is situated such that movement of said valve body results in movement of said primary orifice restrictor, said nozzle being movably connected to said open end of said reservoir body.

19. An art instrument having a self-contained reservoir for storing and dispensing application liquid, comprising:

a reservoir body for containing the application liquid, said reservoir body having an open end including an opening;

a dispensing assembly that dispenses the application liquid from said reservoir, said dispensing assembly comprising:

an applicator;

a primary orifice restrictor including a channel;

a movable actuating assembly that retains said applicator and said primary orifice restrictor, said actuating assembly being movably connected to said open end of said reservoir body; and a secondary orifice restrictor arranged in said opening of said reservoir body and including an initially closed channel; and a partly movable control mechanism that controls movement of said actuating assembly relative to said reservoir body, said control mechanism having a first configuration on said reservoir body in which said control mechanism allows said channel of said primary orifice restrictor to be in flow communication with said channel of said second orifice restrictor and a second configuration on said reservoir body in which said control mechanism prevents engagement of said primary orifice restrictor with said second orifice restrictor and thus opening of said channel of said secondary orifice restrictor to thereby maintain said channel of said secondary orifice restrictor in a closed state until manual movement of said control mechanism into said first configuration, and wherein said primary orifice restrictor includes a protruding tube end through which said channel of said primary orifice restrictor passes and which is configured to frictionally fit inside of said channel of said secondary orifice restrictor, said primary orifice restrictor being arranged such that said protruding tube end opens said closed channel of said secondary orifice restrictor when said control mechanism is moved from said second configuration to said first configuration.

20. An art instrument having a self-contained reservoir for storing and dispensing application liquid, comprising:

a reservoir body for containing the application liquid, said reservoir body having an open end including an opening;

a dispensing assembly that dispenses the application liquid from said reservoir, said dispensing assembly comprising:

an applicator;

a primary orifice restrictor including a channel;

a movable actuating assembly that retains said applicator and said primary orifice restrictor, said actuating assembly being movably connected to said open end of said reservoir body; and a secondary orifice restrictor arranged in said opening of said reservoir body and including an initially closed channel; and a partly movable control mechanism that controls movement of said actuating assembly relative to said reservoir body, said control mechanism having a first configuration on said reservoir body in which said control mechanism allows said channel of said primary orifice restrictor to be in flow communication with said channel of said second orifice restrictor and a second configuration on said reservoir body in which said control mechanism prevents engagement of said primary orifice restrictor with said second orifice restrictor and thus opening of said channel of said secondary orifice restrictor to thereby maintain said channel of said secondary orifice restrictor in a closed state until manual movement of said control mechanism into said first configuration, and wherein said control mechanism comprises a movable regulating ring arranged around said open end of said reservoir body, said regulating ring being maintained on said reservoir body during movement of said control mechanism between said first and second configurations, and wherein said regulating ring comprises an annular portion having an inner diameter that is larger than an outer diameter of said reservoir body at said open end and at least one control flange extending from said annular portion toward a closed end of said reservoir body.

21. An art instrument having a self-contained reservoir for storing and dispensing application liquid, comprising:

a reservoir body for containing the application liquid, said reservoir body having an open end including an opening;

a dispensing assembly that dispenses the application liquid from said reservoir, said dispensing assembly comprising:

an applicator;

a primary orifice restrictor including a channel;

a movable actuating assembly that retains said applicator and said primary orifice restrictor, said actuating assembly being movably connected to said open end of said reservoir body; and a secondary orifice restrictor arranged in said opening of said reservoir body and including an initially closed channel; and a partly movable control mechanism that controls movement of said actuating assembly relative to said reservoir body, said control mechanism having a first configuration on said reservoir body in which said control mechanism allows said channel of said primary orifice restrictor to be in flow communication with said channel of said second orifice restrictor and a second configuration on said reservoir body in which said control mechanism prevents engagement of said primary orifice restrictor with said second orifice restrictor and thus opening of said channel of said secondary orifice restrictor to thereby maintain said channel of said secondary orifice restrictor in a closed state until manual movement of said control mechanism into said first configuration, and wherein said actuating assembly comprises a valve body that retains said applicator and said primary orifice restrictor and a nozzle having an interior in which said valve body is situated such that movement of said valve body results in movement of said primary orifice restrictor, said nozzle being movably connected to said open end of said reservoir body.

22. An art instrument having a self-contained reservoir for storing and dispensing application liquid, comprising:

a reservoir body for containing the application liquid, said reservoir body having an open end including an opening;

dispensing means for dispensing the application liquid from said reservoir, said dispensing means comprising:

an applicator;

a primary orifice restrictor including a channel;

a movable actuating assembly that retains said applicator and said primary orifice restrictor, said actuating assembly being movably connected to said open end of said reservoir body; and a secondary orifice restrictor arranged in said opening of said reservoir body and including an initially closed channel; and control means for controlling movement of said actuating assembly relative to said reservoir body, said control means being arranged on or around said reservoir body and being arranged to require manual movement of a part thereof while said part is maintained on or around said reservoir body in order to open said closed channel of said secondary orifice restrictor by permitting movement of said actuating assembly relative to said reservoir body until said primary orifice restrictor engages said secondary orifice restrictor and opens said channel of said secondary orifice restrictor, and wherein said primary orifice restrictor includes a protruding tube end through which said channel of said primary orifice restrictor passes and which is configured to frictionally fit inside of said channel of said secondary orifice restrictor, said primary orifice restrictor being arranged such that said protruding tube end opens said closed channel of said secondary orifice restrictor when said regulating ring is moved from said second configuration to said first configuration.

23. An art instrument having a self-contained reservoir for storing and dispensing application liquid, comprising:

a reservoir body for containing the application liquid, said reservoir body having an open end including an opening;

dispensing means for dispensing the application liquid from said reservoir, said dispensing means comprising:

an applicator;

a primary orifice restrictor including a channel;

a movable actuating assembly that retains said applicator and said primary orifice restrictor, said actuating assembly being movably connected to said open end of said reservoir body; and a secondary orifice restrictor arranged in said opening of said reservoir body and including an initially closed channel; and control means for controlling movement of said actuating assembly relative to said reservoir body, said control means being arranged on or around said reservoir body and being arranged to require manual movement of a part thereof while said part is maintained on or around said reservoir body in order to open said closed channel of said secondary orifice restrictor by permitting movement of said actuating assembly relative to said reservoir body until said primary orifice restrictor engages said secondary orifice restrictor and opens said channel of said secondary orifice restrictor, and wherein said manually movable part of said control means comprises a regulating ring arranged around said open end of said reservoir body, and wherein said regulating ring comprises an annular portion having an inner diameter that is larger than an outer diameter of said reservoir body at said open end and at least one control flange extending from said annular portion toward a closed end of said reservoir body.

24. An art instrument having a self-contained reservoir for storing and dispensing application liquid, comprising:

a reservoir body for containing the application liquid, said reservoir body having an open end including an opening;

dispensing means for dispensing the application liquid from said reservoir, said dispensing means comprising:

an applicator;

a primary orifice restrictor including a channel;

a movable actuating assembly that retains said applicator and said primary orifice restrictor, said actuating assembly being movably connected to said open end of said reservoir body; and a secondary orifice restrictor arranged in said opening of said reservoir body and including an initially closed channel; and control means for controlling movement of said actuating assembly relative to said reservoir body, said control means being arranged on or around said reservoir body and being arranged to require manual movement of a part thereof while said part is maintained on or around said reservoir body in order to open said closed channel of said secondary orifice restrictor by permitting movement of said actuating assembly relative to said reservoir body until said primary orifice restrictor engages said secondary orifice restrictor and opens said channel of said secondary orifice restrictor, and wherein said actuating assembly comprises a valve body that retains said applicator and said primary orifice restrictor and a nozzle having an interior in which said valve body is situated such that movement of said valve body results in movement of said primary orifice restrictor, said nozzle being movably connected to said open end of said reservoir body.

* * * * *